US007785453B2

(12) United States Patent
Dulle et al.

(10) Patent No.: US 7,785,453 B2
(45) Date of Patent: Aug. 31, 2010

(54) ELECTRODE FOR ELECTROLYTIC CELL

(75) Inventors: Karl Heinz Dulle, Olfen (DE); Roland Beckmann, Lünen (DE); Randolf Kiefer, Bochum (DE); Peter Woltering, Neuenkirchen (DE)

(73) Assignee: Uhdenora S.p.A., Milan (IT)

( * ) Notice: Subject to any disclaimer, the term of this patent is extended or adjusted under 35 U.S.C. 154(b) by 588 days.

(21) Appl. No.: 11/795,474

(22) PCT Filed: Feb. 10, 2006

(86) PCT No.: PCT/EP2006/001246

§ 371 (c)(1),
(2), (4) Date: Jul. 17, 2007

(87) PCT Pub. No.: WO2006/084745

PCT Pub. Date: Aug. 17, 2006

(65) Prior Publication Data

US 2008/0116081 A1 May 22, 2008

(30) Foreign Application Priority Data

Feb. 11, 2005 (DE) ..... 10 2005 006 555

(51) Int. Cl.
*C25B 11/02* (2006.01)
*C25B 11/03* (2006.01)

(52) U.S. Cl. ..... 204/283; 204/288; 204/289; 204/252; 204/263; 205/618; 205/620; 205/624

(58) Field of Classification Search ..... 204/283, 204/288, 289, 252, 263; 205/618, 620, 624
See application file for complete search history.

(56) References Cited

U.S. PATENT DOCUMENTS

| | | | | |
|---|---|---|---|---|
| 4,265,719 | A * | 5/1981 | Ezzell et al. | 205/338 |
| 4,469,577 | A * | 9/1984 | Schmitt et al. | 204/252 |
| 5,114,547 | A * | 5/1992 | Ullman | 205/620 |
| 5,384,208 | A | 1/1995 | Brand et al. | |
| 6,503,377 | B1 * | 1/2003 | Borucinski et al. | 204/257 |

FOREIGN PATENT DOCUMENTS

DE 44 15 146 A1 11/1995

* cited by examiner

*Primary Examiner*—Bruce F Bell
(74) *Attorney, Agent, or Firm*—Charles A. Muserlian

(57) ABSTRACT

An electrode for electrochemical processes for gas production, which in the installed state is located parallel and opposite to an ion exchange membrane and consists of a multitude of horizontal lamellar elements which are structured and three-dimensionally shaped and are in contact with only one surface with the membrane, wherein the lamellar elements have grooves and holes, the major part of the holes being placed in the grooves and the surfaces of such holes or part thereof are located in the grooves or extend into the grooves whereby the holes are ideally placed in the contact area of the respective lamellar element with the membrane.

14 Claims, 4 Drawing Sheets

ELECTRODE FOR ELECTROLYTIC CELL

This application is a 371 of PCT/EP2006/001246 filed Feb. 10, 2006.

The invention relates to an electrode for electrochemical processes for the production of gases such as chlorine from aqueous alkali halide solutions, which in the assembled state is positioned parallel and opposite to an ion-exchange membrane and consists of a multitude of horizontal lamellar elements. The lamellar elements are structured and three-dimensionally shaped, part of the surface thereof being in direct contact with the membrane, and are provided with grooves and holes, wherein the majority of the holes is located in the grooves and the overall surface area of such holes or part thereof is located in the grooves or extends therein. Preferably the holes are located in the contact area of the relevant lamellar element with the membrane.

BACKGROUND OF THE INVENTION

Gas-producing electrochemical processes and the corresponding electrodes to be used in electrolytic appliances are known in the art; such electrodes are for instance disclosed in DE 198 16 334. The above patent describes an electrolyser for the generation of halogen gases from aqueous alkali halide solutions. As the product gas in the electrolyte negatively affects the flow behaviour in the membrane/electrode area, DE 198 16 334 suggests the installation of individual louver-type elements inclined to the horizontal plane. In this way a lateral flow is established in the cell because the gas bubbles gathering under the individual lamellar elements run upwards through the openings.

DE 198 16 334 however does not suggest how to overcome the problem that a certain amount of gas gets trapped underneath the louver-type elements, so that a considerable fraction of the membrane surface area is blinded. The fluid circulation is hindered in the blinded area, in which the gas production cannot therefore take place. Moreover, the gas stagnation diminishes the local membrane conductivity, leading to an increase in the current density in the remaining zones, which in turn leads to increased cell voltage and energy consumption.

In order to eliminate this blinding effect, EP 0 095 039 discloses lamellar elements provided with transverse recesses. In DE 44 15 146 however it is stated that said recesses are insufficient to prevent blinding. Consequently DE 44 15 146 discloses lamellar elements provided with bores or openings pointing downwards so that the gas discharge flow is enhanced.

However, this method does not solve the problem of the residual gas fraction trapped in correspondence of the contact areas and hindering the electrolyte flow.

SUMMARY OF THE INVENTION

It is therefore one of the objects of the present invention is to provide an electrode overcoming said deficiency, preventing or minimising the blinding phenomena.

This and other objects of the present invention which will be made clear by the following description are achieved by an electrode according to the appended claim 1. The electrode according to the invention for use in electrolysers for gas-producing electrochemical processes is arranged parallel and opposite to an ion-exchange membrane in the installed state and consists of a multiplicity of structured and three-dimensionally shaped horizontal lamellar elements.

Part of the surface of the lamellar elements is in direct contact with the membrane, and said elements are provided with at least one groove, extending into the surface portion of the lamellar element in direct contact with the membrane, said at least one groove being provided in its turn with at least one hole. Preferably, the lamellar elements are provided with a multiplicity of grooves and a multiplicity of holes, the major part of the holes being located in the grooves, so that at least part of the hole surface is located in the grooves or extends into the same.

In a particularly preferred embodiment the holes are arranged in the contact area of the respective lamellar element with the membrane. Even more preferably, the grooves provided with holes are disposed on the side facing the membrane, and are free of obstacles to the flow. As the electric current takes the path of least resistance, the electrode has an essential advantage that on the one hand the region subjected to the highest current density, i.e. the contact area, is supplied with an ideal escape for the downward stream of fluid via the groove, and on the other hand the much more voluminous product gas is conveyed upwards via the groove or via the holes to the rear side of the electrode.

Moreover, it was found that positioning the holes in the grooves is an ideal solution because the smallest membrane-electrode gap can be established in the contact area without the holes being closed by the superposition with the membrane, with a partial or complete obstruction of the fluid feed.

It was also possible to determine that such hole position is optimal because the complete internal surface area of the hole acts as an active electrode surface on account of the close vicinity of the membrane. If a hole diameter smaller than the thickness of the sheet is selected, all of the holes effectively contribute to the enlargement of the overall active electrode surface.

In a particularly preferred embodiment of the invention, two or more holes are arranged in a groove in the contact area with the membrane.

In a particular embodiment of the invention the lamellar elements are shaped as a sickle consisting of two flanks linked by an arched transitional area. The arched section points towards the membrane and both flanks are inclined at an angle of 10 degrees to the membrane.

In a preferred embodiment of the invention the individual lamellar elements are shaped as a flat C-profile from an initially slightly convex section, which in the installed state is parallel to the membrane. Upon installation the two or more flank parts are inclined at least 10 degrees to the membrane. One or several transitional portions with any profile are arranged between the slightly convex part and the flank parts. Advantageously the transitional areas are formed as rounded edges.

The surface areas of the lamellar element in accordance with the invention are characterised by the parameter FV1 which is the ratio between the contact surface and the free active surface area, according to the formula $$FV1=(F2+F3)/(F1+F4+F5)$$

wherein:

F1 is the groove surface area in the F2 portion,

F2 is the strip-type contact area with the membrane,

F3 is the transitional area from the strip-type contact area to the groove wall, F4 is the surface area of hole wall and F5 is the surface area of groove walls in F2 portion.

In a preferred embodiment of the invention, FV1 is lower than 0.5, more preferably lower than 0.15. The sheet thickness in the region of the holes is greater than 30% of the hydraulic diameter of the holes. The hydraulic diameter is defined as the ratio between the quadrupled surface area and the perimeter of the free flow cross section, which in case of circular holes is equivalent to the geometric diameter. In a particularly preferred embodiment the sheet thickness in the region of the recesses does not exceed 50% of the above mentioned hydraulic diameter.

The holes of the electrode in accordance with the invention may have a shape of any kind, for instance they can be advantageously shaped as thin slots with a width smaller than 1.5 mm.

A preferred embodiment of the electrode of this invention provides that the groove depth be limited in order to obtain groove walls and bases as active electrode surfaces better suited for the reaction while keeping the fluid resistance not too high, said depth being smaller than 1 mm or more preferably smaller than 0.5 mm, or even more preferably not higher than 0.3 mm.

Moreover, in a preferred embodiment the ratio FV2 between the total surface of the contact area and the total surface of the area not coming in contact with the membrane is set smaller than 1 or more preferably smaller than 0.5 and even more preferably smaller than 0.2. FV2 is defined as follows:

$$FV2=F6/(F1+F2)$$

wherein F1 and F2 are the above defined values representing the projected surface of the contact area and F6 represents the flank surface area of the lamellar element directly facing the membrane, said flank surface being inclined away and not coming in contact with the membrane.

Under another aspect, the invention is directed to an electrolytic process for the production of a halogen gas from aqueous alkali halide solutions, said process being implemented by means of electrodes of the invention or by means of electrolysers using such electrodes.

In a preferred embodiment, the above-mentioned electrolytic process for halogen gas production makes use of electrolysers of the single-cell type of filter-press design, incorporating the electrode of the invention as an essential component.

BRIEF DESCRIPTION OF THE DRAWINGS

The invention is described hereinafter with the aid of the attached drawings which are provided by way of example and shall not be intended as a limitation of the scope thereof, wherein.

DETAILED DESCRIPTION OF THE INVENTION

Figure 1A:
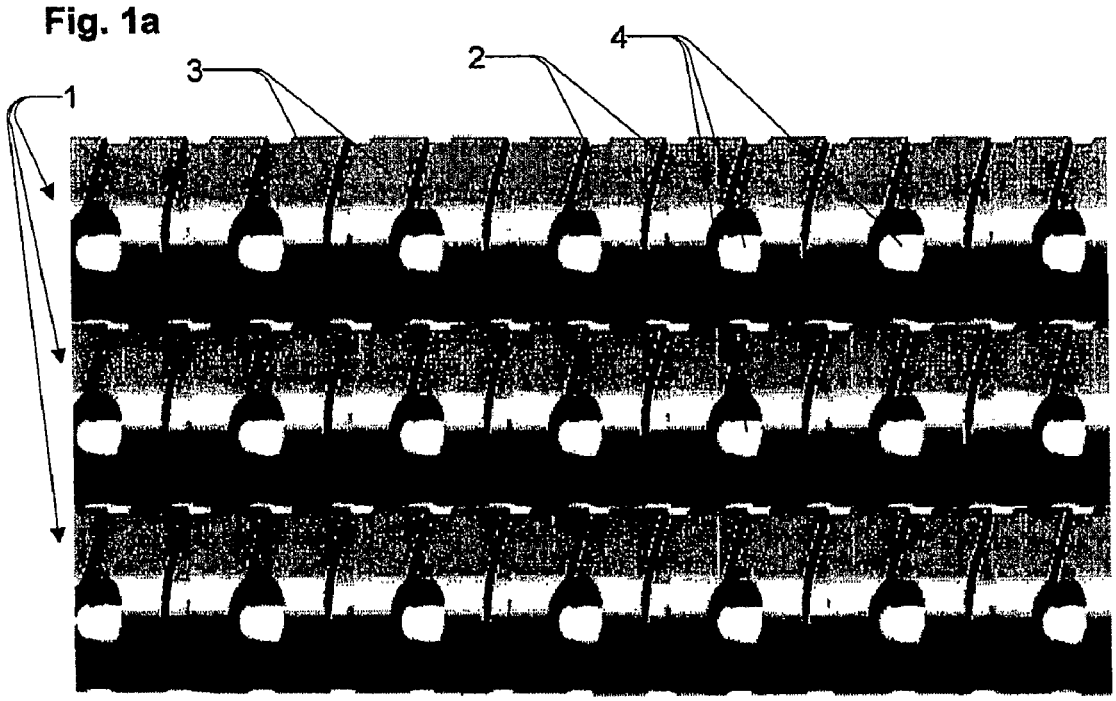
FIG. 1*a* is a perspective view of the electrode of the invention.

FIG. 1 shows a perspective view of the electrode of the invention represented as three parallel lamellar elements 1 provided with grooves 2 and strip-type surfaces 3 therebetween. In this particular example, a hole 4 is positioned in every other groove 2 crossing the lamellar element 1 from the front side, corresponding to the visible surface, to the rear side.

Figure 1B:
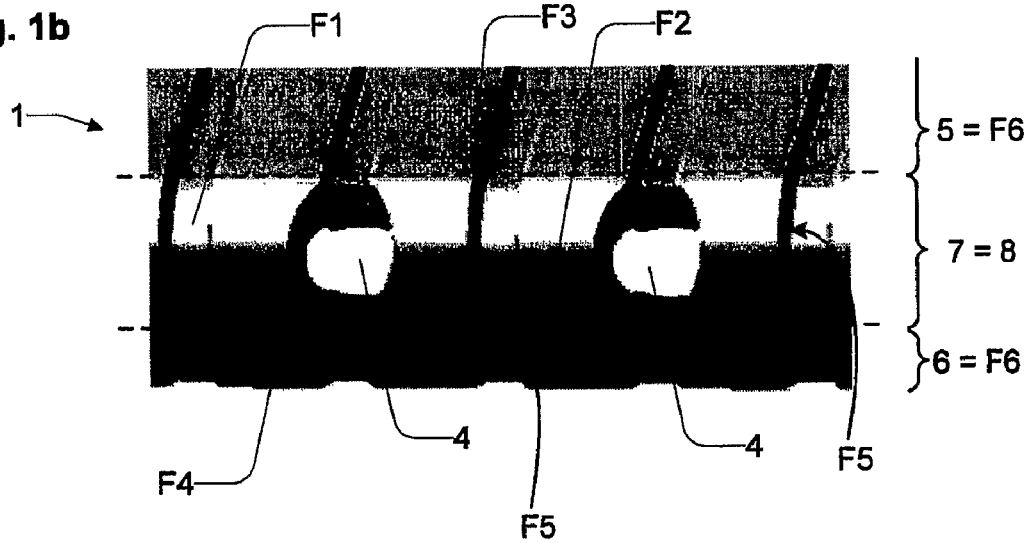
FIG. 1*b* is a detail thereof.

As represented in detail in FIG. 1*b* the lamellar elements 1 consist of two flank elements, an upper flank 5 and a lower flank 6, linked by means of an arched transitional area or elbow 7. The holes 4 are exactly placed in the transitional area 7 which, upon electrode installation, is positioned in the centre of the contact area 8 with the membrane 9. In this embodiment, contact area 8 almost coincides with transitional area 7 and is formed by surface areas F1 to F3, wherein F2 represents the strip-type contact area with the membrane, F1 the groove surface area in the F2 portion, and F3 the transitional area from the strip-type contact surface to the groove wall.

Figure 2A:
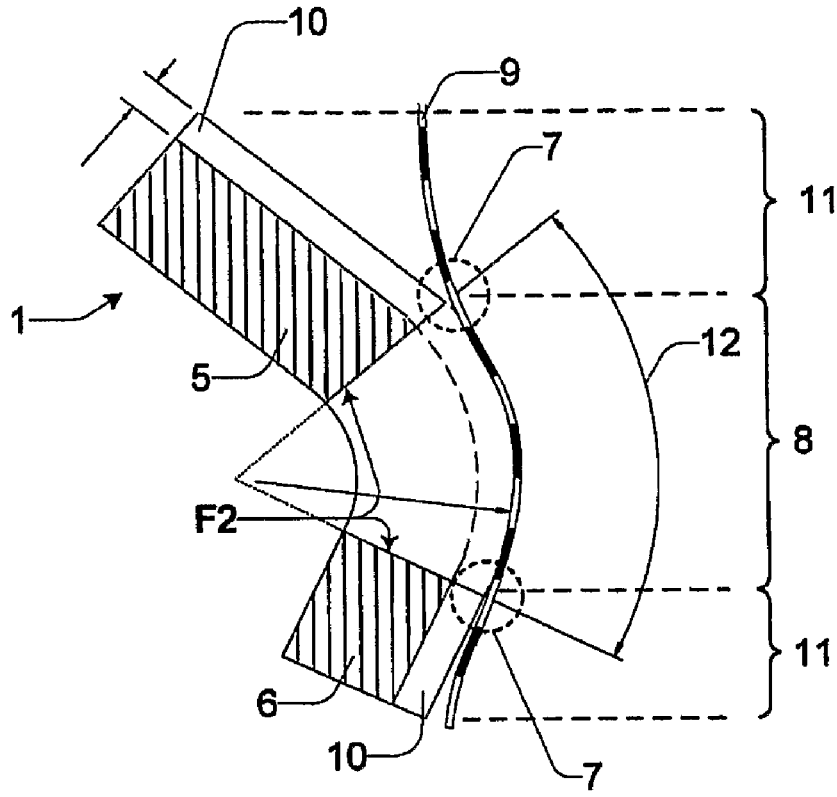
FIGS. 2*a* and 2*b* show the lamellar element in detail.

In the cross-sectional view of FIG. 2*a* relative to the same embodiment, the membrane 9 follows the contour of lamellar element 1 above the groove wall 10. The curvature angle 12 defines the position and width of the gap-area of membrane 9 to the lamellar element 1 and it is located between contact area 8 and area of no contact with the membrane 11. The curvature angle 12 has been chosen in the above example in such a manner that the minor radii of the elliptically extended hole circumferences end up in the above-mentioned gap area of membrane 9 to lamellar element 1. This design has the major advantage that an enlarged volume is available for the complicated gas discharge and fluid feed into the narrow groove region. The transitional area 7 in which membrane 9 is detached from the lamellar element is identified with the aid of a dotted circle.

Figure 2B:
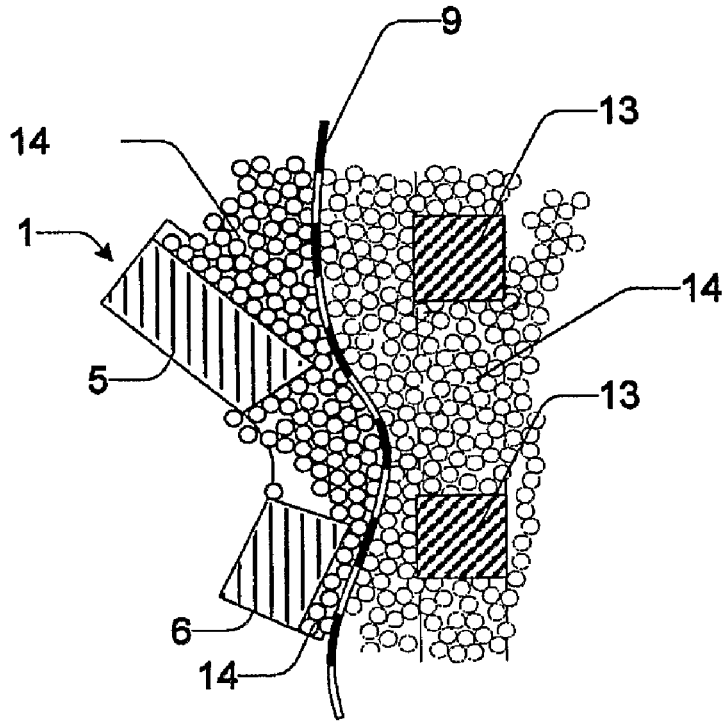

FIG. 2*b* depicts the same lamellar element 1 upon installation and during operation. Counter-electrode 13 faces the opposite side of the membrane 9 and both electrodes are flooded by brine or caustic (not shown) and by gas bubbles 14. Moreover, FIG. 2*b* shows the assembly used for chlor-alkali production wherein the anode, which in this case is the lamellar element 1 in direct contact with the membrane, faces the cathode, which in this case is the counter-electrode 13. As FIG. 2*b* illustrates, a gap is maintained between the membrane 9 and the cathode 13 because the caustic acting as the catholyte has a relatively good conductivity. In this example the counter-electrode 13 is made of a mesh of expanded metal.

Figure 3:
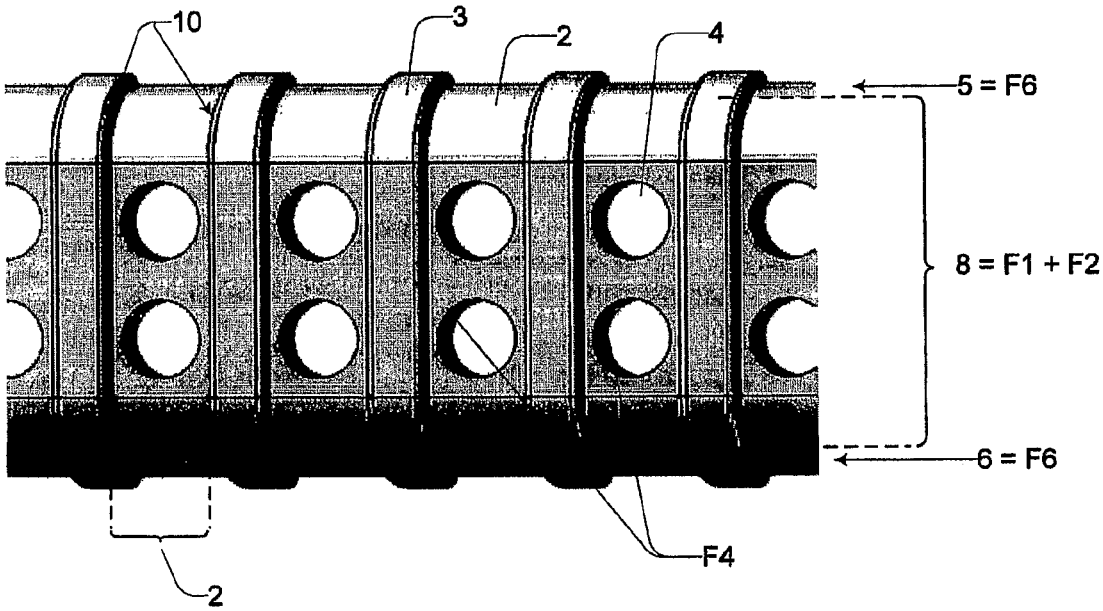
FIG. 3 shows a lamellar element having a flat C-type profile.

FIG. 3 shows a lamellar element 1 of a flat C-type profile. The grooves 2 are sufficiently wide that the holes 4 do not cause any weakening of the groove wall 10. The width of the strip-type surfaces 3 is approx. only ⅓ of the width of the grooves 2. Furthermore, backward arched flanks 5 and 6 are very short and the contact area comprising surface areas F1 to F3 is many times greater. The FV2 surface area ratio defined above is smaller than 0.2 in the case of the illustrated example. The essential advantage of this embodiment is that an active area parallel to membrane 9 is arranged between the two transitional areas 7 ensuring an ideal condition for the electrochemical reaction. The groove 2 is supplied through holes 4 with caustic or brine, dragged by the ascending gas bubbles.

Figure 4:
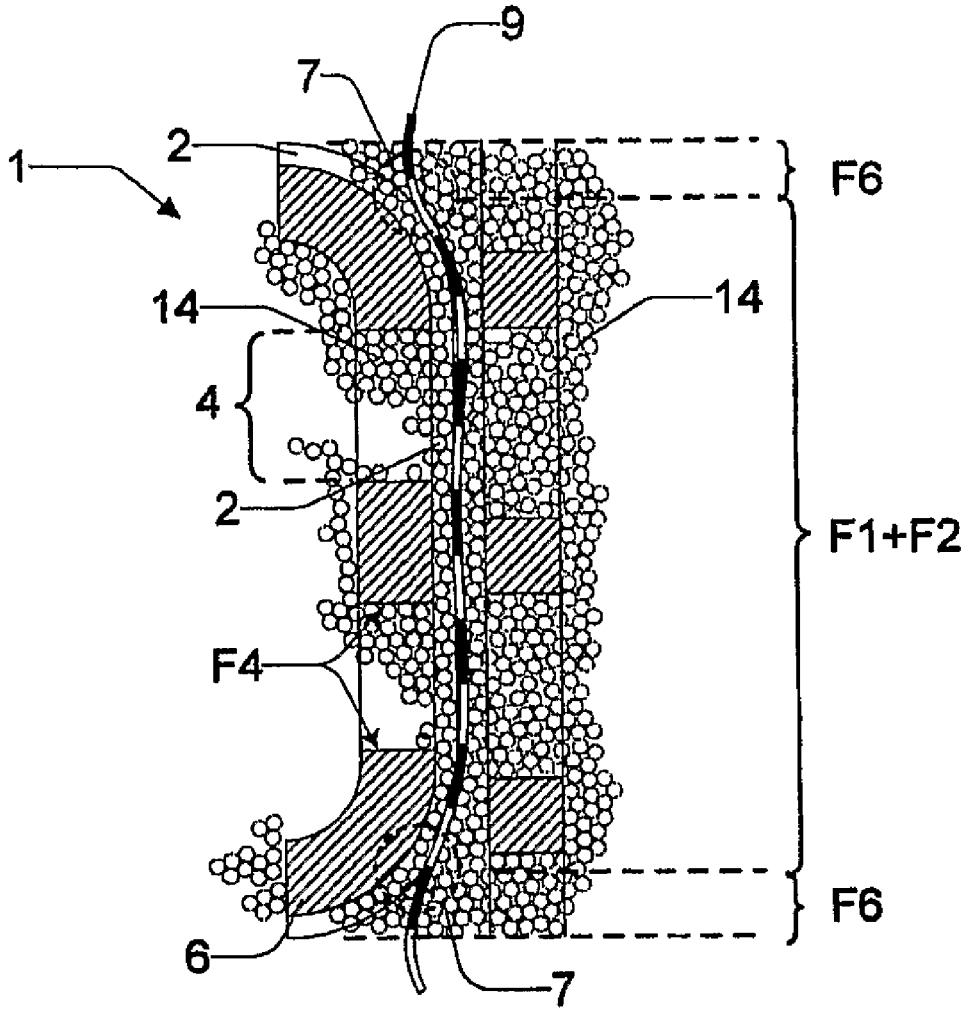
FIG. 4 is a side-view of the lamellar element of FIG. 3.

FIG. 4 shows the above-mentioned embodiment. As represented in FIG. 4, the portion of lamellar element not facing the membrane 9 is shielded against the ascending gas bubbles 14 by means of lower flank 6 so that the gas bubbles formed in the holes 4 are led away and caustic or brine can be dragged into the groove 2. The transitional area 7, in which membrane 9 is detached from the lamellar element, is identified with the aid of a doffed circle.

The sickle-profiled lamellar elements of the invention allow an enlargement of the active electrode surface area of approx. 3.14 $mm^2$ per hole, for a hole diameter of 2 mm and a sheet thickness of 1 mm in correspondence of the groove. Hence, in the case of a standard electrolytic cell equipped with the electrodes of the invention, a 0.11 $m^2$ increase of the active surface area is obtained by means of approximately 105 000 individual holes. The cell voltage of a 2.7 $m^2$ electrode according to the invention, characterised by a sickle-type profile, was measured in a test cell. A considerable voltage decrease of more than 50 mV was detected at a current density of 6 kA/$m^2$ compared to an electrode of the prior art of equivalent external dimensions.

The invention claimed is:

1. An electrode for gas-producing electrochemical processes in an electrolyser equipped with an ion-exchange membrane, comprising a multiplicity of horizontal three-dimensionally shaped lamellar elements having a surface portion in direct contact with the ion-exchange membrane, said lamellar elements being provided with at least one groove extending into the surface portion in direct contact with the membrane and said at least one groove being provided with at least one hole wherein said at least one hole is located in said surface portion in direct contact with the ion-exchange membrane.

2. An electrode of claim 1 wherein said grooves are disposed on the electrode side facing the ion-exchange membrane and are free of obstacles to the flow.

3. An electrode of claim 1, wherein said at least one hole is a multiplicity of holes.

4. An electrode of claim 1, wherein the individual lamellar elements have the shape of a sickle comprising two flank elements linked by a transitional area, said transitional area being arched towards the membrane and said flank elements being inclined at least 10 degrees to the membrane.

5. An electrode of claim 4 wherein the contact surface to free active electrode surface ratio (F2+F3)/(F1+F4+F5), wherein F1 is the groove surface area in the F2 portion, F2 is the strip-type contact area with the membrane, F3 is the transitional area from the strip-type contact area to the groove wall, F4 is the surface area of hole wall and F5 is the surface area of groove walls in F2 portion, is smaller than 0.5.

6. An electrode of claim 5 wherein the groove thickness in correspondence of the hole is greater than 40% of the hole hydraulic diameter.

7. An electrode of claim 5, wherein the groove depth is smaller than 1 mm.

8. An electrode of claim 7 wherein the groove depth is not greater than 0.3 mm.

9. An electrode of claim 5 wherein said contact surface to free active electrode surface ratio is smaller than 0.15.

10. An electrode of claim 1 wherein the individual lamellar elements have the shape of a flat C-profile formed from an initially slightly convex section and comprising at least one flank element inclined at least 10 degrees to the membrane and at least one transitional area arranged between said slightly convex section and said at least one element.

11. An electrode of claim 1 wherein the ratio (F6/(F1+F2), wherein F1 is the groove surface area in the F2 portion, F2 is the strip-type contact area with the membrane, F6 is the flank surface area of the lamellar element directly facing the membrane, is smaller than 1.

12. An electrode of claim 11, wherein said ratio F6/(F1+F2) is smaller than 0.2.

13. An electrolyser, optionally of the single-cell construction type or of the filter-press construction type for production of halogen gas from aqueous alkali metal halide solutions, wherein it comprises at least one electrode of claim 1.

14. An electrolytic process for production of halogen gas, comprising supplying the electrolyser of claim 13 with an aqueous alkali metal halide solution and applying an external electric current thereto.

* * * * *